US009208973B2

(12) United States Patent
Pabst et al.

(10) Patent No.: US 9,208,973 B2
(45) Date of Patent: Dec. 8, 2015

(54) SLIDING CONTACT SWITCH

(75) Inventors: Michael Pabst, Pegnitz (DE); Alfons Müller, Eschenbach (DE)

(73) Assignee: ZF FRIEDRICHSHAFEN AG, Friedrichshafen (DE)

( * ) Notice: Subject to any disclaimer, the term of this patent is extended or adjusted under 35 U.S.C. 154(b) by 344 days.

(21) Appl. No.: 13/703,285

(22) PCT Filed: May 4, 2011

(86) PCT No.: PCT/EP2011/057118

§ 371 (c)(1),
(2), (4) Date: Apr. 30, 2013

(87) PCT Pub. No.: WO2011/154202

PCT Pub. Date: Dec. 15, 2011

(65) Prior Publication Data

US 2013/0206565 A1 Aug. 15, 2013

(30) Foreign Application Priority Data

Jun. 11, 2010 (DE) ..... 10 2010 029 979

(51) Int. Cl.

| | |
|---|---|
| ***H01H 1/44*** | (2006.01) |
| ***H01H 1/36*** | (2006.01) |
| ***H01H 1/20*** | (2006.01) |
| ***H01H 15/10*** | (2006.01) |
| ***H01H 1/40*** | (2006.01) |
| ***H01H 1/50*** | (2006.01) |

(52) U.S. Cl.

CPC ..... *H01H 15/10* (2013.01); *H01H 1/365* (2013.01); *H01H 1/40* (2013.01); *H01H 1/50* (2013.01); *H01H 2001/406* (2013.01)

(58) Field of Classification Search

CPC ..... H01H 1/36; H01H 2221/014; H01H 1/20; H01H 1/42

USPC ..... 200/252, 550, 541, 506, 1 B, 547

See application file for complete search history.

(56) References Cited

U.S. PATENT DOCUMENTS

| | | | | |
|---|---|---|---|---|
| 5,357,069 | A | 10/1994 | Nishio et al. | |
| 5,587,886 | A | 12/1996 | Lan | |
| 6,979,786 | B2 * | 12/2005 | Aukland et al. | 200/16 A |
| 8,124,896 | B2 | 2/2012 | Ruff | |

FOREIGN PATENT DOCUMENTS

| | | |
|---|---|---|
| DE | 10 2006 011 930 B3 | 2/2007 |
| DE | 10 2007 048 581 B3 | 9/2008 |

OTHER PUBLICATIONS

International Search Report issued in international application No. PCT/EP2011/057118, mailed Jul. 21, 2011 (4 pages).

* cited by examiner

*Primary Examiner* — Renee Luebke
*Assistant Examiner* — Ahmed Saeed
(74) *Attorney, Agent, or Firm* — Brinks Gilson & Lione

(57) ABSTRACT

An electrical sliding contact switch comprises a contact transmitter element with a first and a second rigidly interconnected sliding contact, which are pressed against a corresponding surface designed for a common sliding section by respective contact areas in the same direction, while there is an insulated segment and a contact segment for each sliding contact within the common sliding section respectively, whereby one insulated segment is slid over by a contact area of a sliding contact, when the corresponding other sliding contact is sliding over its contact segment with its contact area, whereby a notch is arranged within the insulating segment which is slid over by a contact area of a sliding contact in case the other sliding contact is sliding over its contact segment.

11 Claims, 2 Drawing Sheets

SLIDING CONTACT SWITCH

Figure 1:
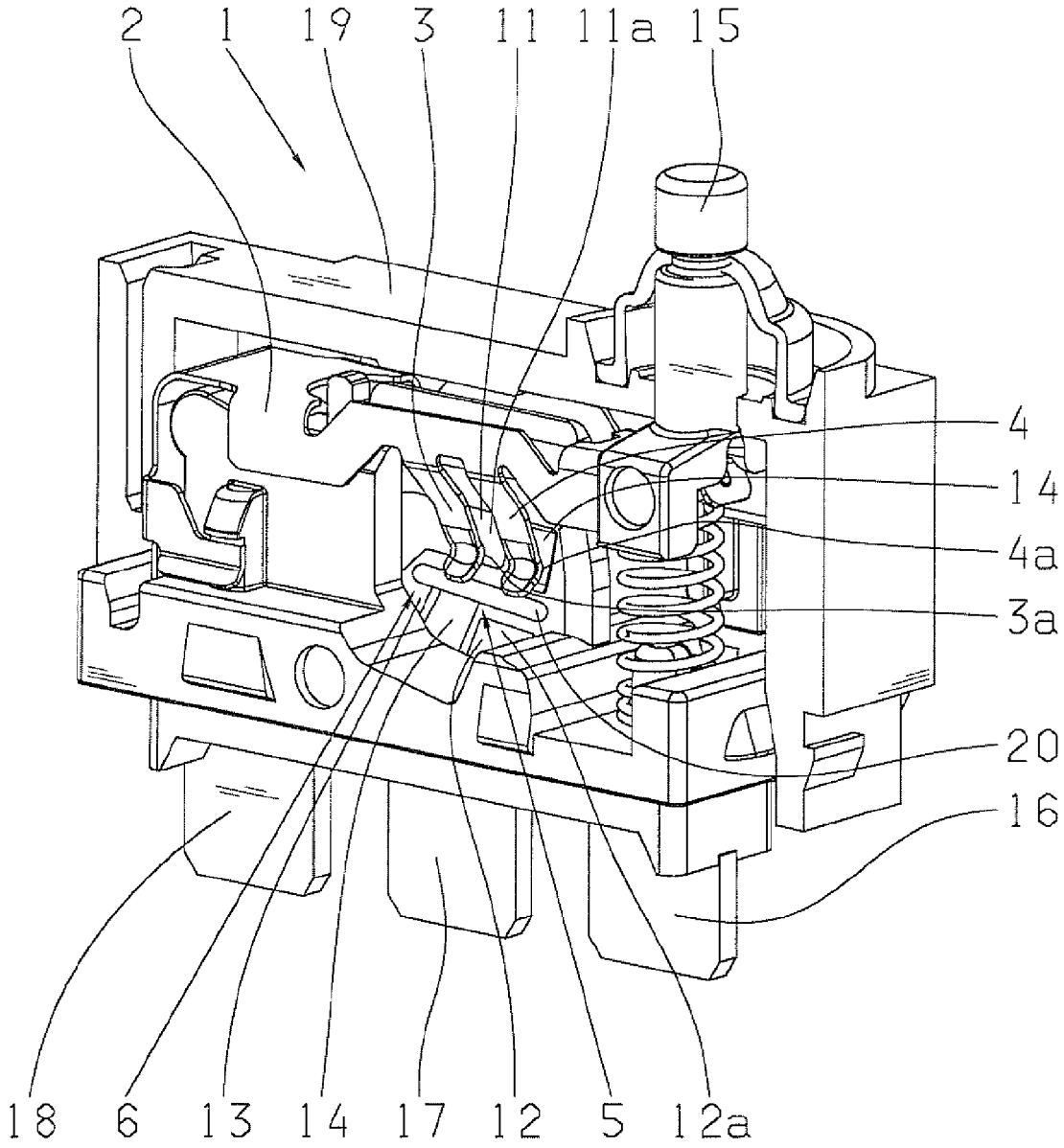

This application is a filing under 35 U.S.C. §371 of International Patent Application PCT/EP2011/057118, filed May 4, 2011, and claims the priority of DE 10 2010 029 979.0, filed Jun. 11, 2010. These applications are incorporated by reference herein in their entirety.

The underlying invention concerns a sliding contact switch according to the preamble of claim 1.

In line with prior art, sliding contact switches of the given type are known from the publication DE 10 2006 011 930 B3 and from the publication DE 10 2007 048 581 B3, which sets the preamble.

The problem with sliding contact switches of the prior art with two or more simultaneously moving sliding contacts that are jointly pressed against one sliding surface is that due to production tolerance variations, during a sliding movement the contact pressure on the affected insulating material of the sliding area adversely influences the contact pressure on the operating contact, i.e., the electrical connecting sliding contact, resulting contact resistance.

Based on this, the underlying invention has the objective to produce a sliding contact switch whose sliding contacts are not adversely influenced by their contact pressure against a contact surface due to production tolerance variations of the insulating material along the sliding path.

The objective is achieved by means of the characteristics of claim 1 according to the invention.

According to the invention an electrical sliding contact switch is suggested, which comprises a contact transmitter element with a first and a second rigidly interconnected sliding contact, which are pressed against a corresponding surface designed for a common sliding section by means of respective contact areas in the same direction, while there is an insulated segment and a contact segment for each sliding contact within the common sliding section respectively, whereby one insulated segment is slid over by a contact area of a sliding contact, when the corresponding other sliding contact is sliding over its contact segment with its contact area, whereby a notch is arranged within the insulating segment which is slid over by a contact area of a sliding contact in case the other sliding contact is sliding over its contact segment.

In the embodiment of the electrical sliding contact switch according to the invention each insulating segment comprises a notch which is slid over when the other sliding contact slides over its contact segment.

In another embodiment of the electrical sliding contact switch according to the invention the notch in the insulating segment is designed to extend over the entire length of the sliding path within the insulating segment.

With yet another embodiment of the electrical sliding contact switch according to the invention, the notch is designed to be a deepening in the insulating layer which is creating the insulating segment, in particular designed as a groove or blind hole.

In line with one aspect according to with the invention of the electrical sliding contact switch, the contact transmitter element is designed in form of a rocker switch.

In line with another aspect according to the invention of the electrical sliding contact switch, the sliding contacts are designed as sliding contact fingers, in particular as elastic pre-stressed sliding contact fingers in regard to the common surface making up the sliding segment.

In line with yet another aspect according to the invention of the electrical sliding contact switch, a contact segment of the sliding section is attached to the chosen contact body and/or an insulating segment of the sliding section is attached to the base or the housing.

An electric sliding contact switch is also suggested where a notch is designed to be at a location within the insulating segment in which the contact area of the sliding contact is in idle position.

Further an electric sliding contact switch according to the invention is suggested, where the sliding contact switch comprises two opposing surfaces with one sliding section each, against which a first and a second sliding contact or their contact area is pressing, whereby the sliding contacts are rigidly interconnected for simultaneous sliding movement, in particular by means of the contact transmitter element.

Also suggested is an electric sliding contact switch according to the invention, where the sliding contact switch comprises two opposing surfaces with one sliding segment each, whereby the sliding segments are arranged in a mirror-symmetrical way.

With an embodiment according to the invention of the electric sliding contact switch, one contact area of the sliding contact moves over the insulating segment without touching it, in case the contact area of the other sliding contact slides over its contact segment.

Further characteristics and advantages of the invention result from the following descriptions of embodiments of the invention, with the help of figures and drawings that display details that are relevant to the invention, and from the claims. The individual characteristics can be realized either individually or coupled in any preferred combination in any variation of the invention.

Figure 2A:
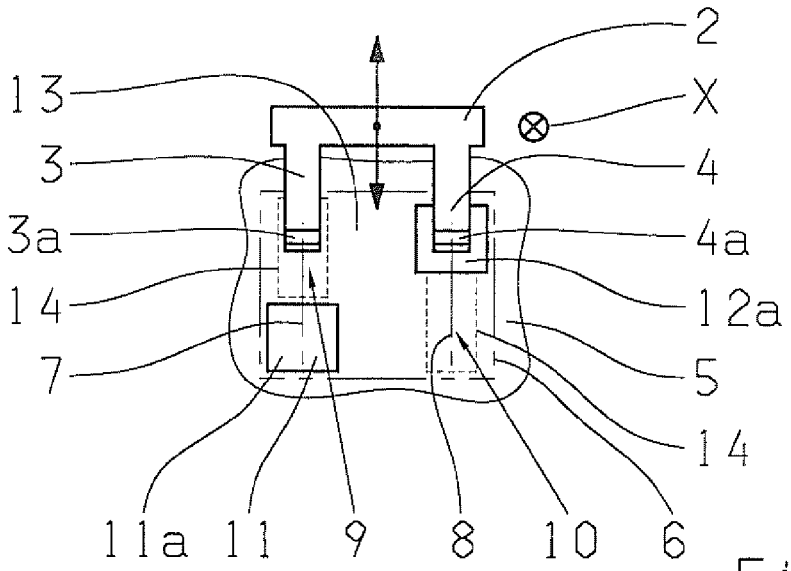
Figure 3:
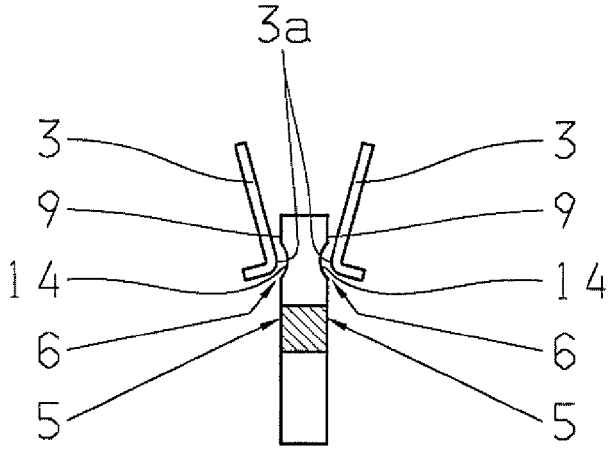

In the following, preferred embodiments of the invention are explained in detail with the help of the attached drawings. It is shown:

FIG. 1 exemplifies an electric sliding contact switch according to a possible embodiment of the invention;

FIGS. 2*a*) and *b*) exemplifies a specially developed sliding section respectively according to the invention; and FIG. 3 exemplifies two specially developed insulating sections at opposing sliding areas in a sectional representation.

In the following figure descriptions the same elements or functions are denoted with the same numbers.

FIG. 1 displays an exemplified electric sliding contact switch 1 according to the invention, which particularly corresponds to the sliding contact switch described in the publication DE 10 2007 048 581 B3 except for characteristics according to the invention which are described in the following. With regard to the description of the construction and function of the sliding contact switch 1 it will additionally be referred to the publication DE 10 2007 048 581 B3.

A sliding contact switch 1 according to FIG. 1 comprises of a contact transmitter element 2 with a first sliding contact 3 and a second 4 sliding contact. The contact transmitter element 2 for example is constructed in one part together with the first sliding contact 3 and the second 4 sliding contact, whereby the sliding contacts 3, 4 are designed as sliding contact fingers in particular. The first sliding contact 3 and the second 4 sliding contact are inflexibly and rigidly interconnected, i.e., e.g., by appropriate design of the contact transmitter element 2. By means of the rigid interconnection, the sliding contacts 3, 4 can be moved together and simultaneously in one switching operation of the sliding contact switch 1, i.e., as a result of the operation of the contact transmitter element 2 (e.g. double arrow in FIGS. 2*a*) and *b*)), whereby they produce a contact pressure in a pressure direction X against a surface 5 during a sliding operation, e.g., by means of elastic pre-stressing.

The first and the second sliding contacts 3, 4 are arranged in the same (pressure-) direction X respectively and are pressed toward a surface 5 with a contact area 3*a*, 4*a*, which creates a common sliding section 6, which means a section within which their sliding contacts 3, 4 can be moved, i.e., sliding over the surface 5 together and simultaneously. Thereby the sliding areas 3*a*, 4*a* are those areas of the sliding contacts 3, 4 which actually can touch the surface 5 during a sliding operation, as displayed e.g., stripe-shaped areas or portions of the sliding contacts 3, 4.

The contact areas 3*a*, 4*a* of the sliding contacts 3, 4 are movable within the common sliding section 6 along the respective sliding path 7, 8, which is defined through the pre-arranged mobility of the contact transmitter element 2 and thus through the sliding contacts 3, 4 relative to the surface 5 (i.e. within the range of possible switching positions; double arrow in FIGS. 2*a*) and 2*b*) and in FIGS. 2*a*) and *b*) e.g., schematically displayed as a line. Each sliding path 7, 8 respectively is assigned to a sliding contact 3, 4 or to its sliding area 3*a* or 3*b*. The aim is to produce equal pressure force onto both sliding paths 7, 8 by means of the sliding contacts 3, 4 which are moving over them. The sliding paths 7, 8 are slid over simultaneously by the sliding contacts 3, 4 or by their contact areas 3*a*, 3*b* during joint movement.

An insulated section 9, 10, i.e. an electrically nonconductive section, and a contact section 11, 12, i.e. an electrically conductive section, are comprised along each of the sliding pathways 7, 8, in the sliding section 6 shared by each of the sliding contacts 3, 4 and the respective contact area 3*a*, 4*a* of said sliding contacts. Thereby the insulating section 9 and the contact section 11 along the sliding path 7 are arranged in opposite sequence with reference to the insulating section 10 and the contact section 12 of the sliding path 8 within the sliding section 6. A contact section 11, 12 is a respective flat segment within the surface 5, designed in particular as a flat segment for a contact area 11*a*, 12*a*. An insulating section 9, 10 is designed within the surface 5 as well.

The (alternate) arrangement of the insulating sections 9, 10 and of the contact sections 11, 12 is made in such a way that an insulating area 9, 10 has to be slid over by a contact area 3*a*, 4*a* of a sliding contact 3, 4 respectively (overlapping in pressure direction X) when the contact area 4*a*, 3*a* of the corresponding other sliding contact 4, 3 slides over its contact section 12, 11 (overlapping in pressure direction X). So, through movement along its sliding path 7, 8 a contact area 3*a*, 4*a* of a sliding contact 3, 4 can be brought into contact with a respective contact section 11, 12 or an insulating section 9, 10. The insulating sections 9, 10 can be formed integrally, e.g., within a common insulating section 13 or as separate sections. The contact sections 11, 12 do not contact each other.

In order to achieve the desired and adequate pressure force onto the respective contact areas 11*a*, 12*a* or contact sections 11, 12 along both sliding paths 7, 8 in a reliable and constant way by means of the contact areas 3*a*, 4*a*, a notch 14 is arranged within an insulating section 9, 10 (recess in the material of the surface 5), which is slid over by the contact areas 3*a*, 4*a* of a sliding contact 3, 4 when the other sliding contact 4, 3 slides over its contact section 12, 11 and connects them in particular. By means of the notch 14 it is possible to prevent that a sliding contact 3 or 4 will rest on an elevated position of the insulating section 9 or 10 in relation to the normal level (opposite to the pressure direction X) along its sliding path 7 or 8, which would displace the rigidly interconnected sliding contact 4 or 3 from its contact area 12*a* or 11*a* and may thus lead to malfunctioning of the sliding contact switch 1.

The notch 14 produces a surface within the insulating area 9, 10 which is lying below the contact area 11*a*, 12*a* (on a lower level) of the contact section 11, 12 on the respective sliding path 7 or 8, when viewed in pressure direction X and it is in particular also nonconductive. The notch 14 comprises, in particular, dimensions which preferably exceed, but at least correspond to, the dimensions of the contact area 3*a*, 4*a* transverse to the pressure direction X, such that the elastically pre-stressed contact area 3*a*, 4*a* can sink into the notch 14 in pressure direction X.

Such a notch 14 has the effect that possible tolerance variations in the production of the insulating section 9, 10 will not have adverse results in that the pressure force of the particular sliding contact 3, 4 which slides over the contact section 11, 12 or which comes in contact with it, cannot be adversely influenced from the other sliding contact 4, 3, which slides over its insulating section 10, 9 at the same time. The invention intends, e.g., that by means of the notch 14 the insulating section 9, 10 does not come in contact with the contact area 3*a*, 4*a* of a sliding contact 3, 4 as long as the respective other contact section 12, 11 is connected or slid over.

Figure 2B:
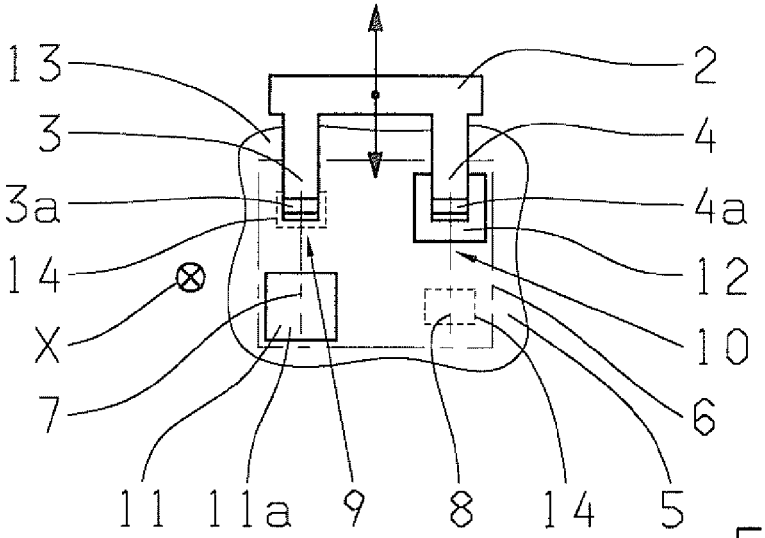

The invention intends to produce a respective notch 14 within all insulating sections 9, 10. These will be slid over, i.e., by a contact area 3*a*, 4*a* of a first sliding contact 3 or second sliding contact 4 when the respective other sliding contact, i.e., the second sliding contact 4 or the first sliding contact 3 slides over or connects to its contact section 12, 11. It can be, e.g., intended that the notch 14 merely is positioned in the section within the insulating section 9, 10, in which a sliding contact 3, 4 or its contact area 3*a*, 4*a* takes a resting place due to a permanent switching position (e.g., FIG. 2*b*). Alternatively the notch can be designed alongside the length, preferably the entire length of the sliding path 7, 8 within the insulating section 9, 10 of, e.g., FIG. 2*a*.

The notch 14 is designed as a deepening within the insolating layer 13 making up the insulating section 9, 10, e.g., in form of a groove or as blind hole, in particular with little depth.

In the embodiment of the sliding contact switch displayed in FIG. 1, the contact transmitter element 2 is designed in form of a rocker switch, which works in conjunction with the actuator 15. The actuator 15 is, e.g., an element for user intervention by means of which the contact transmitter element 2 can be switched or changed between two switching positions (resting positions). In the first switching position, e.g., the first contact section 11 or the first contact area 11*a* is connected through the sliding contact 3, 4, in the second switching position to the second contact section 12 or the second contact area 12*a*.

As is displayed, the sliding contact switch 1 is designed, e.g., as toggle switch (NO-/NC-switch) and comprise a certain chosen first contact connector 16 and a second 17 contact connector for producing the contact areas 11*a*, 12*a* or the contact sections 11, 12. (In line with the idea of the invention other switching variations are included as well). The contact area 11*a* or the contact section 11 is arranged onto the first contact element of choice 16, the contact area 12*a* or the contact section 12 is arranged, e.g., onto the second contact element of choice 17. The contact areas or sections can be connected in relation to the position of the contact transmitter element 2 of the contact transmitter element 2, i.e., by means of its sliding contacts 3, 4.

The electrically conductive contact transmitter element 2 is in constant conductive connection with a further contact element 18, so that it is possible to create an current path in the one as well as the other switching position through the contact element 18, the contact transmitter element 2 and the respectively connected contact element of choice 16 or 17 by means of their contact sections 11 or 12.

The displayed sliding contact switch 1 is made to be a redundant contact system, made out of sliding sections 6 and sliding contacts 3, 4, inasmuch as the first and the second sliding contacts 3, 4 as well as the sliding sections 6 are being made in a duplicated way. A first and a second sliding contacts 3, 4 with their corresponding contact areas 3*a*, 4*a*, respectively, are pressed against surfaces 5 designed as common sliding section 6, whereby the two surfaces 5 are located opposite of each other and form a common sliding section 6, respectively. The surfaces 5 are positioned between two pairs of the first and the second sliding contacts 3, 4, respectively, whereby the contact transmitter element 2 is designed as clamping element for producing the contact pressure or clamping onto the surfaces 5 by means of sliding contacts 3, 4. The sliding sections 6 are, e.g., positioned mirror-symmetrically in relation to each other, as well as the arrangement of the first and second rigidly interconnected sliding contacts 3, 4, respectively, i.e., one first sliding contact 3 and one second sliding contact 4 are arranged mirror-symmetrically to another first sliding contact 3 and second sliding contact 4 and can be moved over the mirror-symmetrical sliding sections 6 mirror-symmetrically simultaneous. The sliding contacts 3, 4 are elastically pre-stressed against the corresponding surface 5, i.e., one pair of respective first and second sliding contacts 3, 4 in direction to an opposite pair of first and second sliding contacts 3, 4. The sliding contacts 3, 4 are all in particular rigidly interconnected to the contact transmitter element 2.

In the embodiment displayed in FIG. 1 according to the invention, each one of contact element of choice 16 or 17 has one of two contact sections 11 or 12, respectively, for the two respective sliding contacts 3 or 4, e.g., for the two first sliding contacts 3, and the further contact element of choice 17 or 16, e.g., two contact sections 12 and 11 for each of the other two sliding contacts 4 and 3 respectively, e.g., the two second sliding contacts 4.

A respective insulating layer 13, within which there are (opposing) insulating sections 9 or 10 arranged on the opposing surfaces 5, is e.g. made out of a base material or housing material which holds or nests the contact element 18 and/or the contact element of choice 16 or 17, i.e., is made of an insulating material, e.g., a plastic material. Alternatively e.g. more insulating layers 13 can be arranged for in order to produce the insulating sections 9 or 10.

Within a respective insulating area 13, a notch 14 is preferably arranged to be within the insulating section 9 or 10, which is slid over by a contact area 3*a* or 4*a* of a sliding contact 3 or 4 when the other sliding contact 4 or 3 slides over its contact section 12 or 11. Notches 14 on opposing insulating sections 9 or 10 are slid over simultaneously from a contact area 3*a* or 4*a* respectively and are preferably arranged mirror-symmetrical, e.g., FIG. 3. Alternatively only one notch 14 is arranged on opposing insulating sections 9, 10, in pressure direction. These notches 14 may be formed at the same time when the base or housing 19 is formed, e.g., by means of injection molding. Alternatively e.g. by means of material removal.

In line with the sliding contact switch 1 according to the invention, e.g., one particular positioning section is defined for the sliding contacts 3, 4 along the sliding paths 7, 8 within the common sliding section 6, within which the contact areas 3*a*, 4*a* are not in connection with the contact sections 11, 12. This section is slid over during a change of switching positions. Within this section, e.g., a rib 20 or a groove is arranged within the sliding path 7, 8 in order to prevent a through connection in the sliding path 7, 8 along the insulating section 9, 10, FIG. 1. Alternatively, a sliding contact switch 1 can be designed without such a breaking element.

NUMERALS

1 sliding contact switch
2 contact transmitter element
3, 4 sliding contact
3*a*, 4*a* contact area of sliding contact
5 surface
6 sliding section
7, 8 sliding path
9, 10 insulating section
9*a*, 10*a* insulating area
11, 12 contact section
11*a*, 12*a* contact area
13 insulating layer
14 notch
15 actuator
16, 17 contact element of choice
18 contact element
19 housing
20 rib or groove
X pressure direction

The invention claimed is:

1. An electrical sliding contact switch, comprising:

a contact transmitter element comprising a first sliding contact and a second sliding contact being rigidly interconnected with the first sliding contact; and a common sliding section comprising:

a first surface, against which the first sliding contact and the second sliding contact press at a first direction and on which the first sliding contact is slidable along a first sliding path and the second sliding contact is slidable along a second sliding path;

a first insulating segment and a first contact segment on the first surface along the first path and a second insulating segment and a second contact segment on the first surface along the second path, being configured so that when the first sliding contact slides over the first insulating segment, the second sliding contact slides over the second contact segment, wherein the first insulating segment comprises a first notch which is slid over by the first sliding contact when the second sliding contact slides over the second contact segment.

2. The electrical sliding contact switch according claim 1, wherein the second insulating segment comprises a second notch which is slide over by the second sliding contact when the first contact slides over the first contact segment.

3. The electrical sliding contact switch according to claim 2, wherein the notches in the insulating segments extend over the entire length of the sliding paths within the insulating segments.

4. The electrical sliding contact switch according to claim 2, wherein the insulating segments are insulating layers; and the notches are one of grooves and blind holes in the insulating layers.

5. The electrical sliding contact switch according to claim 1, wherein the contact transmitter element is in form of a rocker switch.

6. The electrical sliding contact switch according to claim 1, wherein the sliding contacts are elastic pre-stressed sliding contact fingers.

7. The electrical sliding contact switch according to claim 1, further comprising a contact body and a base, wherein one of the first contact segment and the second contact segment is connected to the contact body; and wherein one of the first insulating segment and the second insulating segment is connected to the base.

8. The electrical sliding contact switch according to claim 1, wherein the common sliding section further comprises a second surface opposing to the first surface; and the contact transmitter element further comprises:

a third sliding contact opposing to the first sliding contact, pressing against the second surface at a second direction opposing to the first direction, and being slidable along a third sliding path;

a fourth sliding contact opposing to the second sliding contact, pressing against the second surface at the second direction, and being slidable along a fourth sliding path;

wherein the third sliding contact and the fourth sliding contact are rigidly interconnected for a simultaneous sliding movement.

9. The electrical sliding contact switch according to claim 8, wherein the second surface comprises:

a third insulating segment and a third contact segment respectively opposing to the first insulating segment and the first contact segment in a mirror-symmetric way; and a fourth insulating segment and a fourth contact segment respectively opposing to the second insulating segment and the second contact segment in a mirror-symmetrical way.

10. The electrical sliding contact switch according claim 1, wherein the first sliding contact moves over the first insulating segment without touching the first insulating segment when the second sliding contact slides over the second contact segment.

11. The electrical sliding contact switch according to claim 2, wherein the notches are in positions where their corresponding sliding-contacts take rest.

* * * * *